United States Patent [19]

Grossmann et al.

[11] Patent Number: 4,635,546

[45] Date of Patent: Jan. 13, 1987

[54] ARRANGEMENT FOR PRINTING MACHINE PLATE CYLINDER ZERO POSITION ADJUSTMENT

[75] Inventors: Stefan Grossmann, Radebeul; Erhard Nitzsche, Bohna, both of German Democratic Rep.

[73] Assignee: VEB Kombinat Polygraph "Werner Lamberz" Leipzig, Leipzig, German Democratic Rep.

[21] Appl. No.: 836,234

[22] Filed: Mar. 4, 1986

[30] Foreign Application Priority Data

Mar. 4, 1985 [DD] German Democratic Rep. ... 273755

[51] Int. Cl.[4] ..... B41F 13/14; B41F 33/06

[52] U.S. Cl. ..... 101/248

[58] Field of Search ..... 101/248, 216, 219, 181, 101/152, 153, 136, 141; 340/825.06; 318/65, 572, 600, 601, 603, 626

[56] References Cited

U.S. PATENT DOCUMENTS

| | | | |
|---|---|---|---|
| 3,746,957 | 7/1973 | Forster et al. | 101/248 |
| 4,243,925 | 1/1981 | Gnechtel | 318/603 |
| 4,539,907 | 9/1985 | Johne et al. | 101/248 |
| 4,552,066 | 11/1985 | Giori et al. | 101/152 |

FOREIGN PATENT DOCUMENTS 206648 1/1984 Fed. Rep. of Germany .

*Primary Examiner*—J. Reed Fisher
*Attorney, Agent, or Firm*—Michael J. Striker

[57] ABSTRACT

An arrangement for printing machine plate cylinder adjustment to zero position includes an evaluation circuit which is interposed between a potentiometer which issues an electrical signal representative of the instantaneous position of an adjustment transmission driven by a motor, and motor protection devices for the two senses of rotation of the motor. The evaluation circuit includes an A/D converter unit which is connected at its input side with the potentiometer and at its output side via at least one equivalence circuit and a flip-flop with respective AND-gates which are arranged ahead of the motor protection devices and are also connected at their inputs directly to an output of the A/D converter unit, and at least one additional AND-gate which is connected via at least one up-counter with the equivalence circuit. The arrangement further includes an incremental measuring system including a pulse generator having an output connected to a pulse AND-gate and to the further AND-gate, a counter having an input connected to the output of the pulse generator, and a resetting input connected to the output of said pulse AND-gate, and an indication and control device connected at its input side to the output sides of the counter and of the A/D converter unit.

3 Claims, 4 Drawing Figures

ARRANGEMENT FOR PRINTING MACHINE PLATE CYLINDER ZERO POSITION ADJUSTMENT

BACKGROUND OF THE INVENTION

The present invention relates to control arrangements in general, and more particularly to an arrangement for controlling the adjustment of a plate cylinder of a printing machine to its zero position.

There is already known from the German Democratic Republic Pat. No. 206 648, an arrangement for the adjustment of the zero position of remotely adjustable plate cylinders of printing presses, this adjustment being accomplished by means of four control cams. However, this known adjustment arrangement has the disadvantages of comprising a high number of mechanical elements for the zero position adjustment and the attendant need for time-consuming adjustment, as well as the requirement for zero adjustment after the mechanical elements have suffered a certain degree of wear.

SUMMARY OF THE INVENTION

Accordingly, it is a general object of the present invention to avoid the disadvantages of the prior art.

More particularly, it is an object of the present invention to provide a control arrangement for the adjustment of the zero position of the plate cylinder of a printing press, which does not possess the disadvantages of the known arrangements of this kind.

Still another object of the present invention is so to construct the arrangement of the type here under consideration as to reduce the number of mechanical elements needed for the zero adjustment to a minimum.

It is yet another object of the present invention to develop an arrangement of the above type in which the amount of the adjustment expenditure is minimized.

A concomitant object of the present invention is so to design the arrangement of the above type as to be relatively simple in construction, inexpensive to manufacture, easy to use, and reliable in operation nevertheless.

In pursuance of these objects and others which will become apparent hereafter, one feature of the present invention resides in an arrangement for controlling the operation of a motor, which has a mechanical output connected by a transmission to a plate cylinder of a printing machine and electrical inputs connected to respective protection devices for the two senses of rotation of the motor, during the adjustment of the plate cylinder to a zero position, comprising potentiometer means for detecting and issuing an electrical signal representative of the instantaneous position of the transmission; an evaluation circuit interposed between the potentiometer means and the protection devices and including and A/D converter unit having an input side connected with the potentiometer means and an output side, at least one equivalence circuit having input means connected to the output side of the A/D converter unit and a signal output, a first flip-flop having one input connected to the signal output of the equivalence circuit, another input and an output, two AND-gates each having two inputs, one connected to the output of the first flip-flop and the other to the output side of the A/D converter unit, and an output connected to an associated one of the protection devices, at least one further AND-gate having input means and an output, at least one up-counter interposed between the output of the further AND-gate and the input means of the equivalence circuit, a monoflop having an input connected to the signal output of the equivalence circuit and an output, a pulse AND-gate having one input connected to the output of the monoflop, another input and an output, and a second flip-flop having an input also connected to the output of the monoflop; an input element for zero position having an output connected to the other input of the first flip-flop; and an incremental measuring system including a pulse generator having an output connected to the other input of the pulse AND-gate and to the input means of the further AND-gate, a counter having an input connected to the output of the pulse generator, a resetting input connected to the output of the pulse AND-gate and output means, and an indication and control device having an input side connected to the output means of the counter and to the output side of the A/D converter unit.

It is particularly advantageous for the A/D converter unit to include a value forming device and an A/D converter device. However, it is also contemplated by the present invention to construct the A/D converter unit merely as an A/D converter unit.

A particular advantage of the of the present invention is that it provides a control arrangement which does not include any mechanical switching elements for the printing machine plate cylinder zero position adjustment, which need be adjusted manually only once while subsequent all subsequent zero position adjustments are performed fully automatically, and which possesses a high degree of zero position adjustment accuracy.

The novel features which are considered as characteristic of the invention are set forth in particular in the appended claims. The improved control arrangement for printing machine plate cylinder zero position adjustment itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENTS

Figure 1:
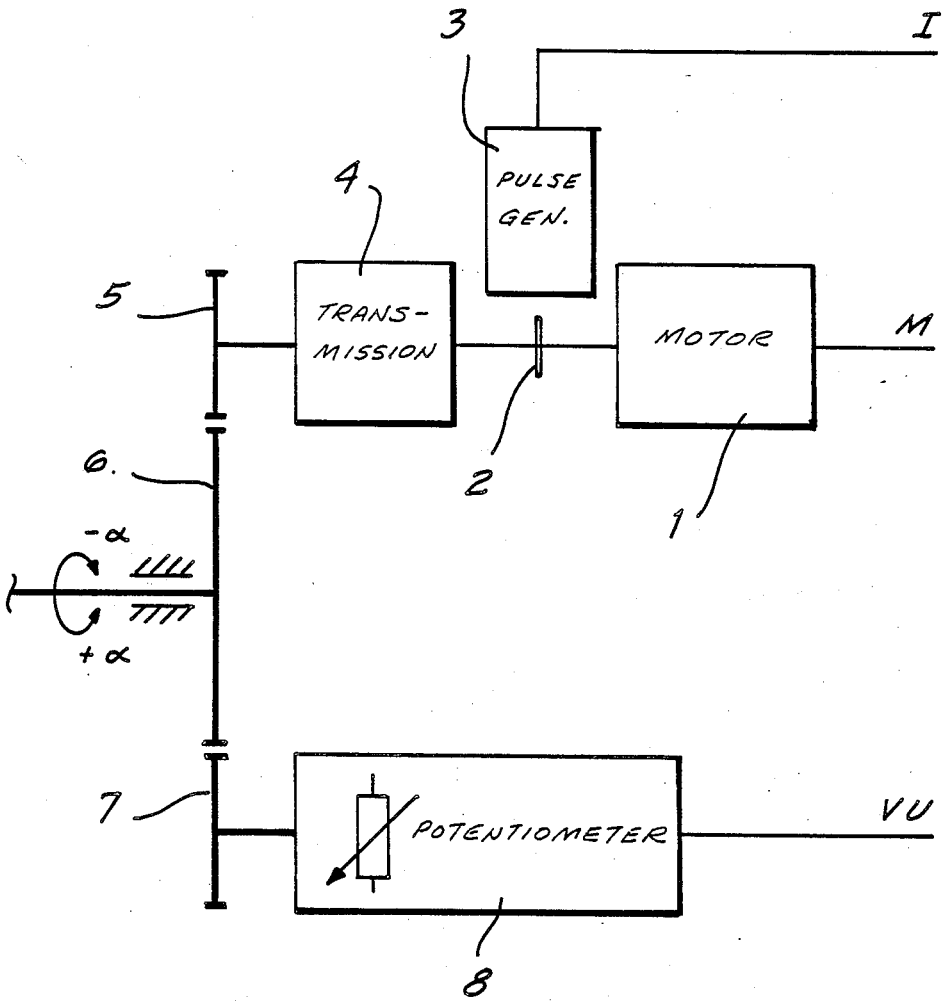
FIG. 1 is a diagrammatic top plan view of an adjustment drive constructed in accordance with the present invention.

Referring now to the drawing in detail, and first to FIG. 1 thereof, it may be seen that it diagrammatically depicts an adjustment transmission for a remote adjustment of a plate cylinder. Two such adjustment transmissions are provided for each plate cylinder, one for the radial, and the other for the axial, adjustment thereof. The mode of operation of both adjustment transmissions, however, is the same, so that the present invention will be explained below in conjunction with only one such adjustment transmission and an associated control arrangement.

A motor 1 is provided at the driving end of the remote adjustment unit. A control cam 2 is mounted for joint rotation on the output shaft of the motor 1, and a pulse generator 3 is associated with this control cam 2. An inductive proximity initiator can be used as the pulse generator 3. The output shaft of the motor 1 is further connected with a highly reducing hypocyclic transmission 4. An output gear 5 is mounted for joint rotation on the output shaft of the transmission 4. The output gear 5 meshes with another gear 6 which causes a direct displacement of the plate cylinder via a non-illustrated worm gear transmission. The other gear 6 further meshes with an auxiliary gear 7 which is mounted for rotation on an auxiliary shaft. A potentiometer 8, which is advantageously constructed as a multi-turn potentiometer, is arranged on the auxiliary shaft of the auxiliary gear 7.

Figure 2:
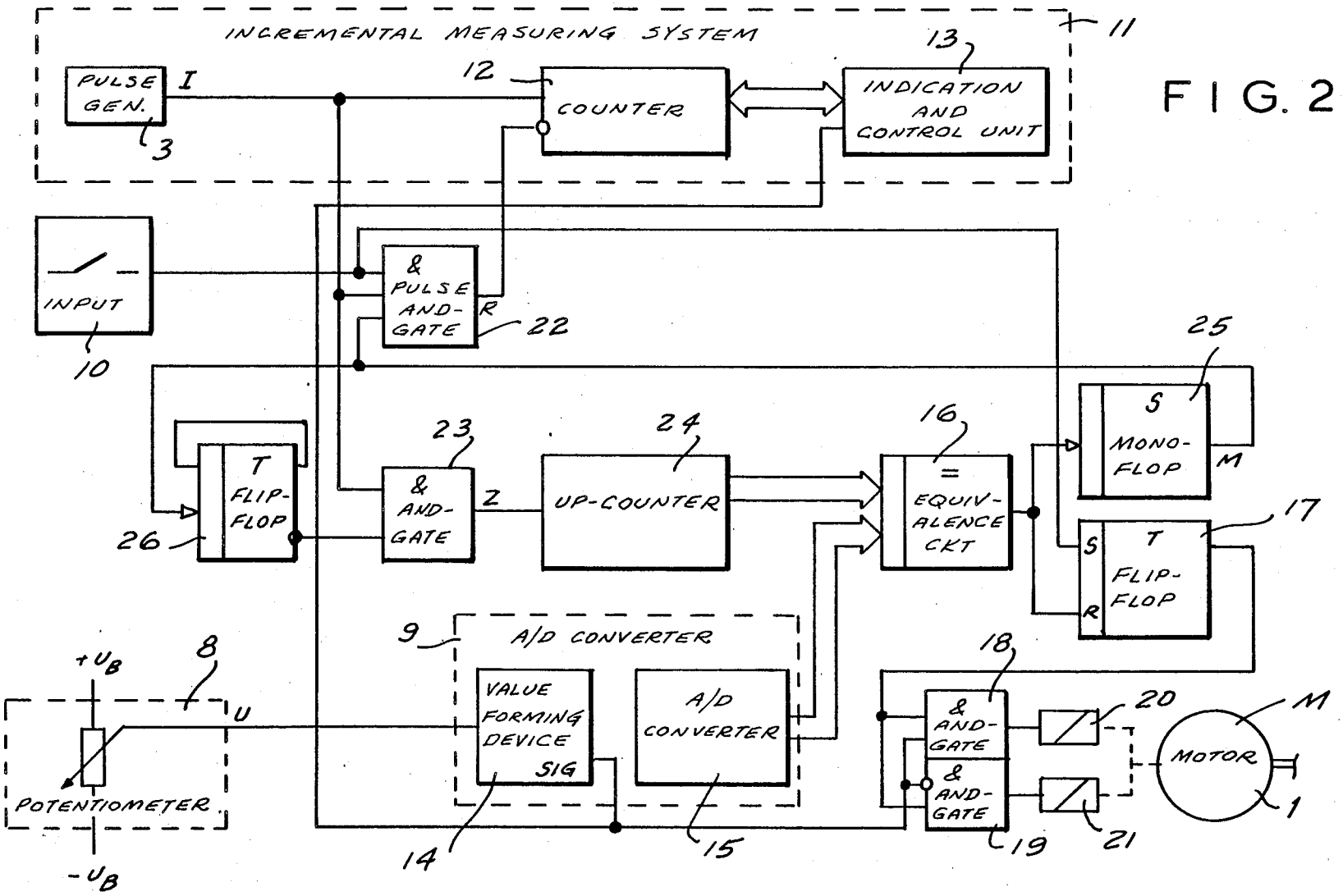
FIG. 2 is a circuit diagram of an electronic control arrangement of the present invention for use with the adjustment drive of FIG. 1.

As illustrated in FIG. 2 of the drawing, an electric output of the potentiometer 8 is connected with an analog-to-digital (A/D) converter unit 9 which includes a value forming device 14 and an A/D converter 15. The value forming device 14 is constituted, for instance, by a two-way precision rectifier. The value forming device 14 has one output which is connected to an input of the A/D converter 15. The A/D converter 15 has a plurality of parallel outputs which are connected with corresponding parallel first inputs of an equivalence circuit 16. The equivalence circuit 16 has an output which is connected to an R input of a first flip-flop 17 and also to an input of a monoflop 25. An S input of the first flip-flop 17, as well as a second input of a pulse AND-gate 22, are connected with an output of an input member 10 for zero position, for the first flip-flop 17 to be influenced in its operation by the input member 10. The output of the first flip-flop 17 is connected to first inputs of AND-gates 18 and 19 for the output signals of the first flip-flop 17 to act on the AND-gates 18 and 19. The AND-gates 18 and 19 have respective outputs which are connected via respective motor protection devices 20 and 21 with the motor 1, so that the signals appearing at the outputs of the AND-gates 18 and 19 switch the motor 1.

The value forming device 14 of the A/D converter unit 9 further has a sign output SIG which is connected to second inputs of the AND-gates 18 and 19 so that the sign signal appearing at the sign output SIG of the value forming device is supplied to such second inputs of the AND-gates 18 and 19. The sign output SIG of the value forming device 14 is additionally connected to an indication and control unit 13 of an incremental measuring system 11. The output of the monoflop 25 is connected with a third input of the pulse AND-gate 22 and with an input of a second flip-flop 26. An output of the second flip-flop 26 is connected with a second input of another AND-gate 23. A first input of this other AND-gate 23 is connected, together with a first input of the pulse AND-gate 22, with the pulse generator 3 which forms a part of the incremental measuring system 11. The output of the other AND-gate 23 is connected with a counting input of an up-counter 24 having parallel outputs which are coupled with corresponding parallel second inputs of the equivalence circuit 16. As already explained before, the inputs of the pulse AND-gate 22 are controlled by the signals appearing at he outputs of the pulse generator 3, the input member 10 for the zero position, and the monoflop 25. The output of the pulse AND-gate 22 acts on a reset input of a counter 12 which is incorporated in the incremental measuring system 11. The counter 12 has a plurality of parallel outputs which are connected to corresponding parallel inputs of the indication and control unit 13.

Having so described the construction of the control arrangement illustrated in FIG. 2 of the drawing, the operation of this control arrangement will now be explained in detail in conjunction with FIGS. 1 and 2, as well as with a timing diagram depicted in FIG. 3 of the drawing.

The potentiometer 8 issues a voltage U which is proportional to the angle of rotation of the gear 7 or to the adjustment displacement of the plate cylinder. The potentiometer 8 must be initially so manually adjusted that the voltage U at the tap or output of the potentiometer 8 has the value of zero when operating with an operating voltage which is symmetrical with respect to the zero point. At the outputs of the value forming device 14, there are always presented, on the one hand, the value of the voltage signal U as an input signal for the A/D converter 15 and, on the other hand, the sign signal appearing at the sign output SIG and serving as the sign for the input voltage U of the A/D converter 15. The sign signal appearing at the sign output SIG is also supplied as a control signal for the sense of rotation to the indication and control unit 13 and to the AND-gates 18 and 19. The binary value appearing at the output of the A/D converter 15 is compared in the equivalence circuit 16 with the binary value stored in the up-counter 24 and the result us used for the formation of switching points a and b which are indicated in FIG. 3 of the drawing. The counters 12 and 24 and the first and second flip-flops 17 and 26 are reset in a customary manner when the operating voltage is switched on. With reference to the timing diagram of FIG. 3 of the drawing, it is to be mentioned that it is assumed therein as an example that the adjustment system is in the left-hand adjustment range before the zero adjustment.

When the input member 10 for the zero position is actuated, the first flip-flop 17 is set by the signal supplied to its input S and the AND-gates 18 and 19 are triggered for the switching on of the motor protection devices 20 and 21. Depending on in which region the adjustment unit is situated, the sign signal is made available at the sign output SIG of the value forming device 14 by means of the positive or negative value of the voltage U picked up by the potentiometer 8 and, as a result of this, the sense of rotation of the motor 1 is determined by means of the AND-gates 18 and 19 and of the motor protection devices 20 and 21 in such a manner that a movement toward the zero position occurs. Prior to the issuance of the command for the movement toward the zero position, the up-counter 24 has been reset to zero due to the resetting action accompanying or immediately following the switching on of the operating voltage. As a result of the comparison of the values carried by the A/D converter outputs with the values carried by the up-counter outputs, which comparison is performed by means of the equivalence circuit 16, there is obtained a resetting of the first flip-flop 17 exactly at the zero point. The switching operation is indicated in FIG. 3 by a characteristic line LS. The actual running time of the motor, which is indicated by the characteristic line RD, continues beyond the zero point due to the motor overshoot.

The equivalence circuit 16 also supplies a triggering signal, besides to the first flip-flop 17, to the monoflop 25. Inasmuch as the holding time interval $t_v$ of the monoflop 25 is sufficiently long with respect to the time of the motor overshoot and the still reset second flip-flop 26 furnishes a logic "1" at its inverted output, the pulses I which are generated in the pulse generator 3 are supplied via the other AND-gate 23 to the up-counter 24. In FIG. 3, the characteristic line M represents the output of the monoflop 25 and the characteristic line z represents those of the output pulses I of the pulse generator 3 which are received as input pulses by the up-counter 24.

Irrespective of the state of the second flip-flop 26, the output pulses I issued by the pulse generator 3 are supplied, after the input member 10 for the zero position has been actuated, via the pulse AND-gate 22 to the reset input of the counter 12 which is incorporated in the incremental measuring system 11. In this manner, even the incremental measuring system 11 is reset to zero during each zero adjustment operation.

As the signal M issued by the monoflop 25 is restored to its original value, there is obtained a setting of the second flip-flop 26. A non-inverting output of the second flip-flop 26 is connected to the other input of the second flip-flop 26 and, as a result of this connection, it is assured that subsequent signals M do not effectuate any additional switching. As a result of the setting of the second flip-flop 26, the inverted output of the second flip-flop 26 now carries a logic "0" signal and, consequently, this signal when supplied to the AND-gate 23 causes the latter to close, thus discontinuing the supply of the pulses I of the pulse generator 3 to the input of the up-counter 24, so that the count of the up-counter 24 is stopped at a value proportional to the motor overshoot. The desired zero position is then achieved when the adjustment drive is subsequently controlled at an arbitrary switching point c by means of a non-illustrated follow-up control arrangement and a renewed approach of the zero position is triggered by a renewed setting of the first flip-flop 17.

As already mentioned before, the resetting of the first flip-flop 17 occurs by means of the equivalence circuit 16 when the value of the up-counter 24 coincides with the value appearing at the output of the A/D converter 15. Thus, the value of the up-counter 24, which corresponds to the amount of the motor overshoot, determines the switching point b. Inasmuch as the output value appearing at the output of the equivalence circuit 15 is merely a numerical or absolute value, there is obtained the switching point a which is situated symmetrically to the switching point b with respect to the point 0. This arrangement is based on the assumption that the motor overshoot is the same for both senses of rotation, which is true in most cases. The switching off of the motor 1 at the switching point b is indicated in FIG. 3 by a characteristic line RS, the actual motor running time by a characteristic line LD and the pulses I actually counted by the counter 12 of the incremental measuring system 11 by the characteristic line R.

Figure 3:
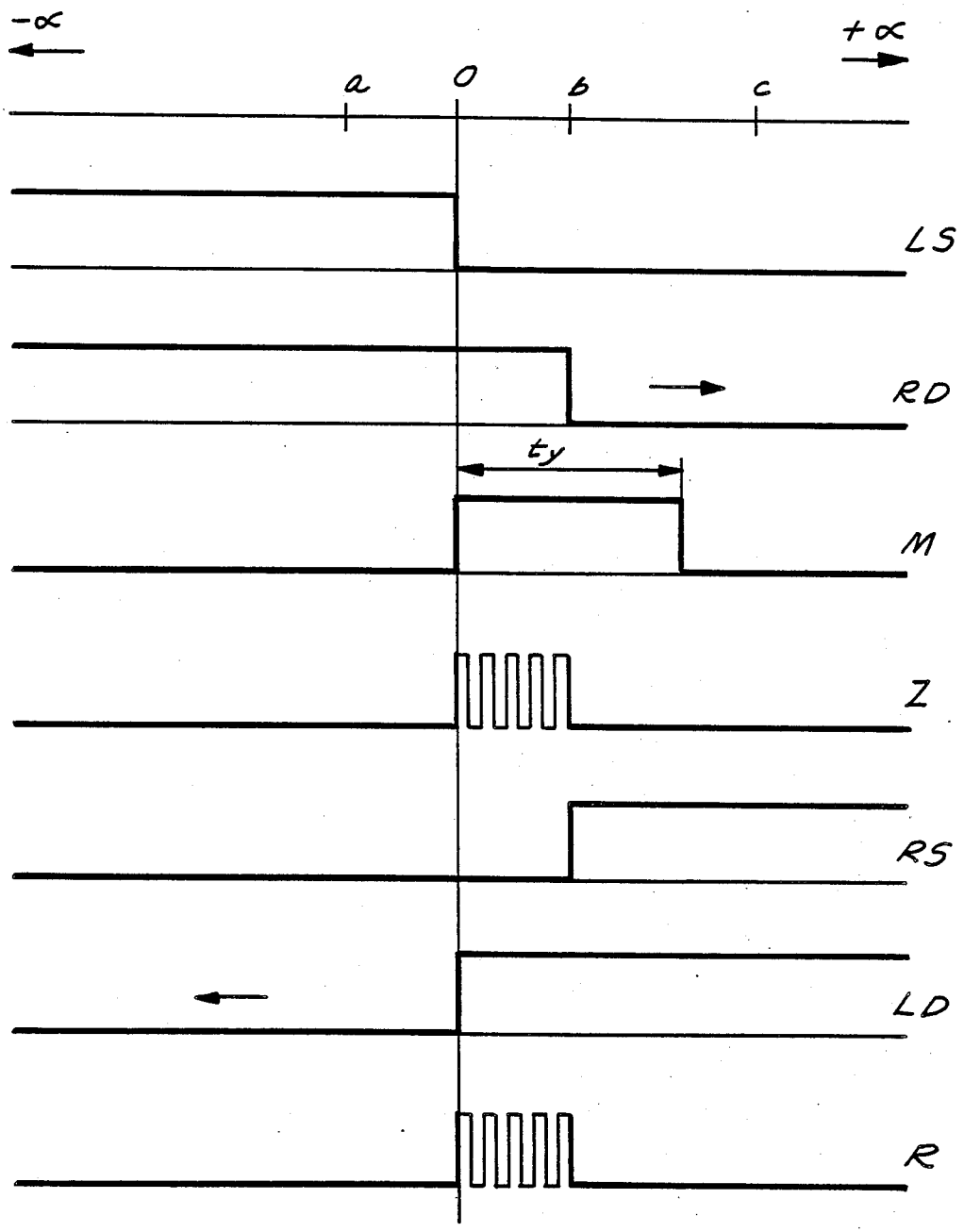
FIG. 3 is a timing diagram of the various signals encountered during the operation of the control arrangement of FIG. 2.
Figure 4:
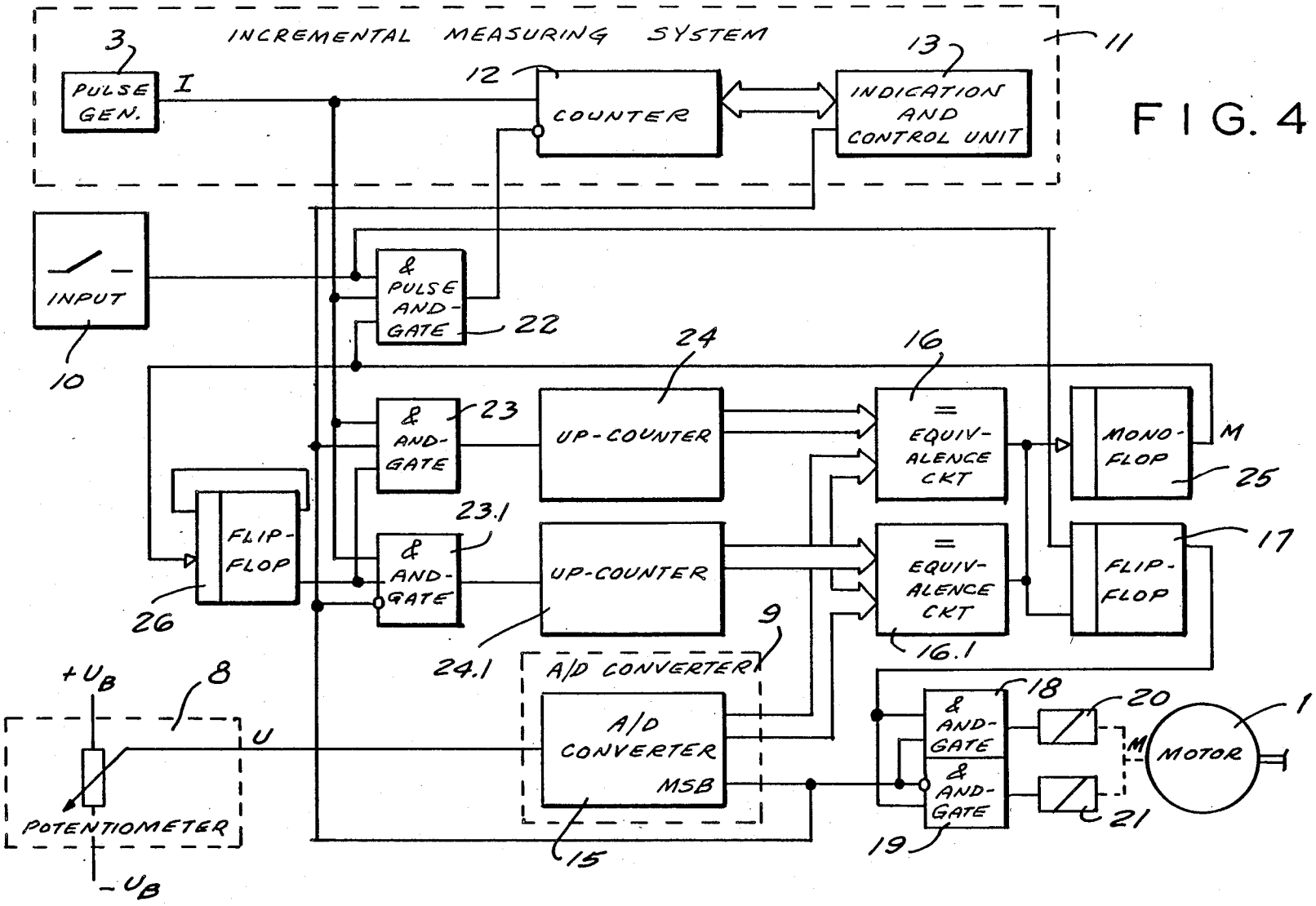
FIG. 4 is a view similar to FIG. 2 but of a modified construction of the control arrangement.

FIG. 4 of the drawing illustrates a modified construction of the control arrangement which, however, is similar or identical to the construction depicted in FIG. 3 in so many respects that the same reference numerals as before have been used to identify the corresponding parts, and that slightly modified reference numerals have been utilized to identify additional parts which serve similar functions as their respective counterparts. This modified control arrangement is designed for use particularly in applications where the amount of the motor overshoot is dependent on the sense of rotation. In this modified construction, two separate up-counters 24 and 24.1 are provided 24 for the opposite senses of rotation. Then, the parallel outputs of the A/D converter 15 are commonly connected to the first inputs of two separate equivalence circuits 16 and 16.1 and the respective outputs of the up-counters 24 and 24.1 are separately connected to the second inputs of such separate equivalence circuits 16 and 16.1. The outputs of the two equivalence circuits 16 and 16.1 are connected in parallel for the output signals appearing at such outputs to act in the previously described manner on the resetting input of the first flip-flop 17 and on the input of the monoflop 25. The above-discussed amount forming device 14 can be and has been omitted from this modified construction. It is ten possible to use the most significant bit (MSB) output signal of the A/D converter 15 to provide the information concerning the sense of rotation. The amount formation can also be advantageously accomplished by means of a non-illustrated microcomputer by the formation of the two's complement to the output value of the A/D converter.

In view of the fact that it is possible by using the above-described control arrangement to determine after the putting of the plate cylinder control arrangement in operation and during the first zero adjustment operation the amount of the motor overshoot, and to use the thus obtained information for the formation of the switching points for the zero position adjustment, the mechanical wear of the brake for the motor 1 and of the following hypocyclic gear transmission 4 can be corrected within certain limits. As a result of this, there is obtained, in addition to a high accuracy during the zero point adjustment operation, also a high operational durability.

It will be understood that each of the elements described above, or two or more together, may also find a useful application in other types of arrangements differing from the type described above.

While the invention has been illustrated and described as embodied in an arrangement for controlling the adjustment of a printing cylinder to its zero position, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. An arrangement for controlling the operation of a motor, which has a mechanical output connected by a transmission to a plate cylinder of a printing machine and electrical inputs connected to respective protection devices for the two senses of rotation of the motor, during the adjustment of the plate cylinder to a zero position, comprising potentiometer means for detecting and issuing an electrical signal representative of the instantaneous position of the transmission; an evaluation circuit interposed between said potentiometer means and the protection devices and including and A/D converter unit having an input side connected with the potentiometer means and an output side, at least one equivalence circuit having input means connected to said output side of said A/D converter unit and a signal output, a first flip-flop having one input connected to said signal output of said equivalence circuit, another input and an output, two AND-gates each having two inputs, one connected to said output of said first flip-flop and the other to said output side of said A/D converter unit, and an output connected to an associated one of the protection devices, at least one further AND-gate having input means and an output, at least one up-counter interposed between said output of said further AND-gate and said input means of said equivalence circuit, a monoflop having an input connected to said signal output of said equivalence circuit and an output, a pulse AND-gate having one input connected to said output of said monoflop, another input and an output, and a second flip-flop having an input also connected to said output of said monoflop; an input element for zero position having an output connected to said other input of said first flip-flop; and an incremental measuring system including a pulse generator having an output connected to said other input of said pulse AND-gate and to said input means of said further AND-gate, a counter having an input connected to said output of said pulse generator, a resetting input connected to said output of said pulse AND-gate and output means, and an indication and control device having an input side connected to said output means of said counter and to said output side of said A/D converter unit.

2. The arrangement as defined in claim 1, wherein said A/D converter unit includes an amount forming device and an A/D converter device.

3. The arrangement as defined in claim 1, wherein said A/D converter unit includes an A/D converter device.

* * * * *